United States Patent [19]

Hanley et al.

[11] 4,248,334

[45] Feb. 3, 1981

[54] RECYCLING APPARATUS

[75] Inventors: C. John Hanley, Fords, N.J.; Frank Morris, Yardley, Pa.

[73] Assignee: PepsiCo Inc., Purchase, N.Y.

[21] Appl. No.: 886,333

[22] Filed: Mar. 13, 1978

[51] Int. Cl.³ ..... G07F 7/06

[52] U.S. Cl. ..... 194/4 C; 194/1 E; 194/4 R; 194/4 E; 100/DIG. 2

[58] Field of Search ..... 194/1 E, 1 R, 4 R, 4 B, 194/4 C, 4 D, 4 E, 4 F, 4 G; 209/524, 538; 250/223 B; 232/43.3; 241/99; 100/DIG. 2; 198/394

[56] References Cited

U.S. PATENT DOCUMENTS

| | | | |
|---|---|---|---|
| 2,800,159 | 7/1957 | Walsh et al. | 100/DIG. 2 X |
| 2,887,204 | 5/1959 | Giuliano | 194/4 R |
| 2,908,440 | 10/1959 | Gurewitz | 194/4 F X |
| 3,039,583 | 6/1962 | Menefee | 194/4 C |
| 3,412,837 | 11/1968 | Myers | 194/4 R |
| 3,430,766 | 3/1969 | Stone | 209/524 |
| 3,792,765 | 2/1974 | Arp | 194/4 C |
| 4,121,514 | 10/1978 | Nickaloff | 100/DIG. 2 X |

*Primary Examiner*—Robert J. Spar
*Assistant Examiner*—Edward M. Wactra
*Attorney, Agent, or Firm*—Scully, Scott, Murphy & Presser

[57] ABSTRACT

A recycling apparatus and method for accepting the return of selected types of used containers and for dispensing compensation for the deposit in the apparatus of an approved type of container. A returned container is placed into a depository in the apparatus wherein a scanner reads code markings on the container. If the code indicates the container is of an acceptable type, the container is deposited in a storage receptacle within which the containers are periodically compacted. The customer has the option of selecting compensation from the apparatus of either a given amount of money or a chit worth more than the given amount which may be credited towards the purchase of select products.

5 Claims, 8 Drawing Figures

RECYCLING APPARATUS

BACKGROUND OF THE INVENTION

1. Field of the Invention

The present invention generally relates to recycling apparatus and, more particularly, pertains to recycling apparatuses of the type adapted to accept the return of select types of used containers of the plastic or metal non-reusable class, and to issue a premium in payment of the container return.

As a consequence of the passage and enactment of legislative bills and ordinances in various states requiring the return or recycling of used beverage containers, and prescribing the sale of non-returnable containers predicated on ecological grounds, the handling of returned containers, such as bottles and cans has become a major problem in many geographical areas. Thus, some states have mandated the return of all used beverage containers, and the handling and logistics thereof have become or are becoming major problems for the suppliers of these products and also for many retail establishments. It is not at all impossible to contemplate for a wholesale delivery driver of these products to have to possibly spend several hours per day sorting used containers at various retail outlets. Further, many retail outlets must necessarily devote an inordinately disproportionate portion of the area of their available floor space to the accumulation and storage of returned containers. As a result, it would be desirable to have readily available a recycling machine or installation for returned containers which is adapted to accept the return of select types of containers such as, for instance, beverage cans or bottles, and which will refund to the returnor a premium in the form of either a monetary deposit refund or a chit redeemable at retail stores with the future purchase of select products.

2. Discussion of the Prior Art

Heretofore, various kinds of arrangements have been disclosed or proposed in the prior art relating to aids in facilitating the handling of returnable, recyclable, containers, particularly beverage containers of different types.

For instance, Arp U.S. Pat. No. 3,857,334 discloses a recycling machine which accepts and crushes or compacts containers possessed of predetermined physical characteristics. Containers, such as metal cans, are processed by the machine adapted to dispense a token as a premium for each container deposited therein and having particularized physical characteristics such as a predetermined size, shape, weight and so forth. Upon the acceptance of a suitable container by the machine, the latter issues to the returnor a premium in the nature of a stamp which may be redeemed at a retail outlet. A recycling machine of this nature does not have the selectivity or versatility required for the types of applications for which the present invention was developed.

Tanaka U.S. Pat. No. 3,907,087 discloses a machine which is designed to accept cans of various sizes, crush or compact each can for storage, and issue a coin refund for the return of each can. Nevertheless, a machine of this nature is not selective enough for use in the processing of returned containers in various areas of commerce, such as in the retail soft drink market.

Other arrangements disclosed in the prior art incorporate optical scanning equipment for ascertaining with a greater degree of precision or discerning the type of product or container being processed, however, these arrangements have found no application in recycling equipment analogous to that contemplated and developed by the present invention.

For instance, Herrin U.S. Pat. No. 3,752,963; Yoneyama U.S. Pat. No. 3,985,999; Rabedeau U.S. Pat. No. 3,947,816; Chadima, Jr. et al U.S. Pat. No. 3,991,299; and Hobart U.S. Pat. No. 3,995,166 all disclose different types of systems for scanning various kinds of markings, typically in the form of universal product code (UPC) symbols imprinted on a product which will provide information with great particularity and accuracy as to the type, nature and manufacturer or origins thereof. However, none of these patents discloses the use of scanning equipment of this nature in a recycling arrangement wherein used containers of selected types, such as beverage cans or bottles, are accepted (or rejected) by a recycling machine in response to the scanned UPC symbol information on the container.

SUMMARY OF THE INVENTION

Accordingly, in order to overcome the limitations encountered in the present state of the technology, the present invention contemplates the provision of an improved and unique recycling apparatus or machine for accepting the return of selected types of used containers, such as beverage cans and bottles, and for compensating the returnor of the container for the deposit therein of an acceptable type of container through the issuance of a premium. Upon insertion of a returned container within the apparatus, an optical system is adapted to scan code markings or indicia on the container to ascertain if the container is one of the selected acceptable types. A control circuit is provided which is responsive to the output of the optical system scanner, and is programmed to cause the machine to either accept or reject the container depending upon the information in the code markings or indicia thereon. A dispenser is responsive to the output of the control circuit, and a premium in compensation, which may take any of several different forms such as a coin or redeemable token, is dispensed to the returnor of the container by the machine if the container falls within the category of the types acceptable to the machine. Returned containers are automatically conveyed to a compactor which periodically compresses or compacts the accepted containers for subsequent accumulation and storage within a recycling receptacle.

In accordance with another feature of the present invention, the recycling apparatus has the premium-compensating apparatus thereof in the form of a coin dispenser adapted to issue a monetary refund, such as a coin of predetermined value, and A chit dispenser which, in a selective manner depending upon the choice made by the returnor, is capable of issuing a coupon redeemable in the purchase of particular products, and in lieu of the coin, with the chit being worth more than the monetary refund provided by the coin dispenser to thereby provide an inducement towards the purchase of such products. Pursuant to this feature of the invention, the customer or returnor has thus the option of receiving either a refund in a given amount of money, or a coupon or chit having a redeemable face value of more than the given monetary amount, with the coupon or chit being redeemable towards the purchase price of particular products. The control circuit is responsive to the indicated selection by the customer and the output of the optical scanner to initiate the refund of either a given monetary amount or the issuance of a chit. Moreover, the recycling apparatus of the present invention may include a plurality of counters for counting the number of returned containers within each of the selected types of categories of acceptable containers.

In accordance with another aspect of the present invention, the control circuit is adapted to activate the compactor periodically after a given number of acceptable containers has been deposited in the machine, thereby resulting in a saving of energy in comparison with continuously operating compacting arrangements. Also pursuant to another feature of the invention, the apparatus includes an infeed depository through which returnable containers are placed in the recycling apparatus by the customer. The depository has a lockable door and, subsequent to the closing and locking of the latter, allows for activation of mechanism for imparting rotation to a container placed therein so as to enable the scanner to detect the identifying indicia or code markings on the container. In further detail, the container infeed depository includes a turntable which is inclined slightly from a horizontal disposition thereof whereby the container rotated thereon bears against at least one substantially vertically oriented roller positioned proximate the circumference of the turntable. The turntable and roller both cooperate in order to rotate a container inserted in the depository and to thereby enable the indicia or code markings thereon to be rotated past the scanner. The container infeed depository is provided with side walls formed by two depending legs of an inverted U-member. The inverted U-member is mounted for pivotal side-to-side movement about a generally horizontal axis located above the depository, and the control circuit causes a pivotal movement of the inverted U-member upon acceptance of a returned container by the recycling apparatus which will convey the container towards the compactor for compacting thereof.

In accordance with a further aspect of the present invention, there is disclosed a novel method for accepting the return of selected types or categories of used containers, such as beverage cans and bottles, and for compensating the returnor for the return of an acceptable type of container. The method contemplates the scanning of indicia or code markings on the container providing identification of the container being one of the selected types, and when affirmative, conveyance into a receptacle for the accumulation of returned containers within the recycling apparatus. The method makes provision for the dispensing of a premium compensation as either a predetermined amount of money or a chit redeemable for the purchase of particular products, with the chit being worth more monetarily than the given amount of money, in response to the return of the container. In accordance with this feature, the customer presses a particular selection button to thereby indicate a choice of either the receipt of a monetary deposit or of the more valuable redeemable chit. The method of the present invention includes activation of a control circuit responsive to both the indicated premium selection by the consumer and the optical scanner to selectively actuate either the monetary dispenser or the chit dispenser.

Accordingly, it is a primary object of the present invention to provide a recycling apparatus of the abovementioned type which is compatible with the variety and quantities of containers being presently returned to many retail establishments.

Another object of the present invention is to provide an apparatus of this nature wherein the more popular returnable containers may be processed by a unitary machine which selectively dispenses to the customer either a monetary return deposit or a redeemable chit predicated on the return of the container and choice of selection made by the customer, and which automatically counts and records the number of each different type of accepted containers deposited in the apparatus.

Yet another object of the present invention lies in the provision of an apparatus of the type described in which the returnable containers are subjected to a compacting action and thereafter stored in the apparatus for further disposal and processing.

Still another object of the invention resides in a method of recycling returnable containers through the intermediary of a recycling apparatus as described hereinabove.

BRIEF DESCRIPTION OF THE DRAWINGS

The foregoing and other objects and advantages of a novel recycling apparatus constructed pursuant to the teachings of the present invention may be more readily understood by one skilled in the art, having reference to the following description of a preferred embodiment thereof taken in conjunction with the accompanying drawings, wherein identical reference numerals are used to refer to the same elements throughout the several figures; and in which.

DETAILED DESCRIPTION OF THE DRAWINGS

Figure 3:
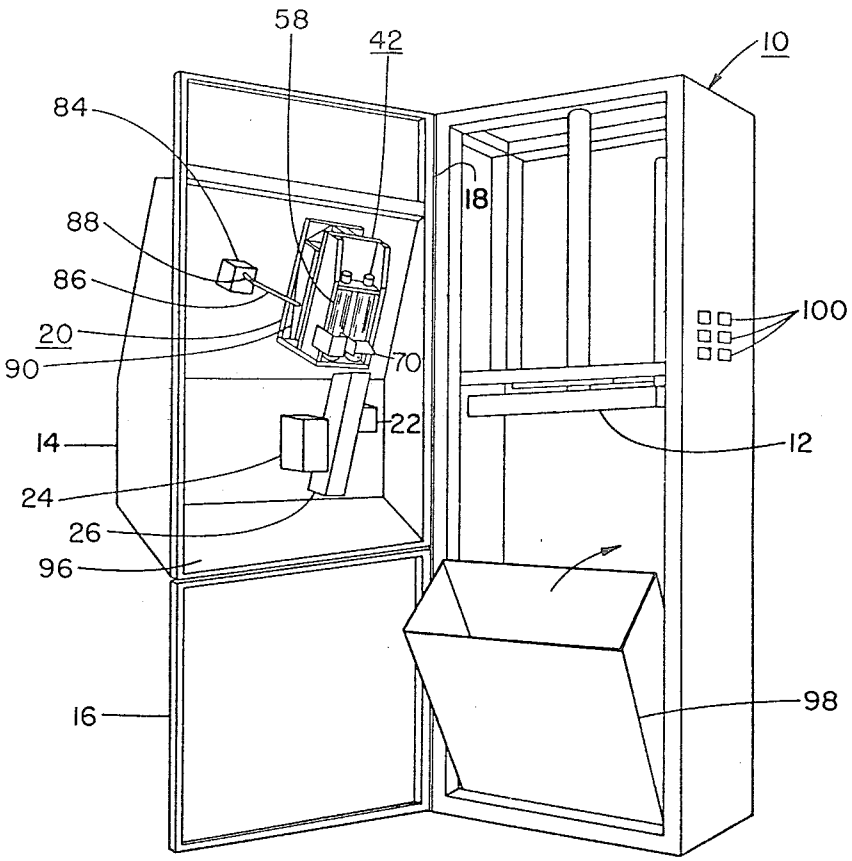
FIG. 3 is a front elevational perspective view of the recycling apparatus with both front panels thereof in opened positions, and showing further details of the internal construction thereof.
Figure 1:
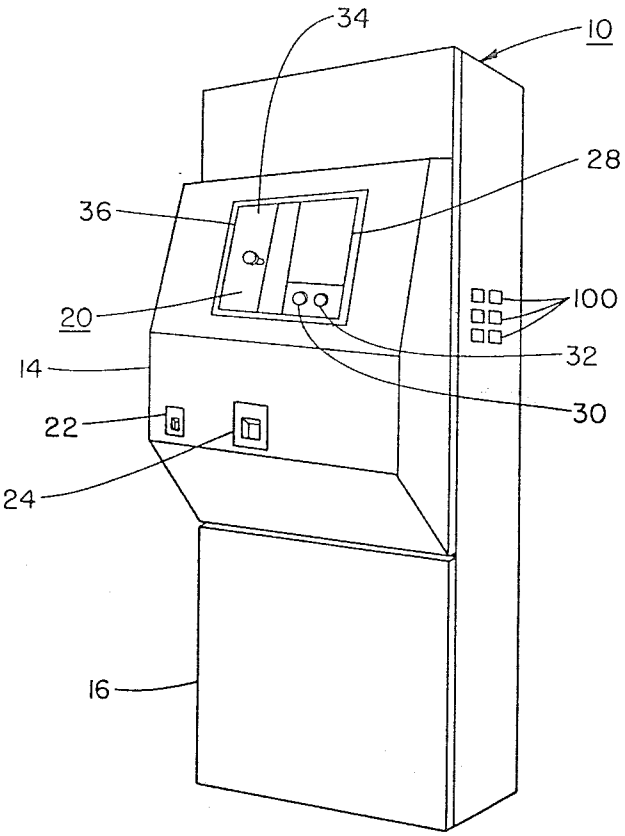
FIG. 1 is a front elevational perspective view of one embodiment of a recycling apparatus constructed pursuant to the teachings of the present invention.

Referring now in detail to the drawings, FIGS. 1 and 3 are front elevational perspective views of one embodiment of a recycling apparatus 10 constructed pursuant to the teachings of the present contribution to the state of the art, shown respectively in a closed and in an opened apparatus condition. Referring to FIGS. 1 and 3, it can be ascertained that the apparatus 10 includes a rear compactor unit 12, and upper and lower front panels 14 and 16 which are pivotally mounted by means of a hinge 18 to the apparatus frame at a front corner of the rear compactor. The upper front panel 14, which extends outwardly, has mounted on the interior thereof a container infeed and depository receptacle or compartment 20 adapted to receive returned containers; a coin dispenser 22 for issuing to the customer a monetary deposit as a premium for the return of an acceptable container; a chit dispenser 24 for alternatively issuing to the customer a chit or token which may be redeemed at a retail store for credit against the purchase of select products; an optical or laser scanner 26 for scanning identifying indicia or code markings on a returned container so as to provide information if it is an acceptable type. The exterior of front panel 14 includes a display panel 28 containing various sets of operating instructions for the customer, and several selection buttons 30 and 32 which enable the customer to indicate his choice of receiving either a monetary refund or a chit redeemable at a retail establishment.

The various components comprising the container depository receptacle 20 are shown in various degrees of detail in FIGS. 1 through 7, and as explained hereinbelow. A front door 34 providing access to the depository receptacle 20 is pivotally connected to the outer surface of the upper front panel 14 through a hinge 36, and which permits the customer access to the interior of the receptacle during selected intervals of the operational cycle of the apparatus 10. A solenoid latch 38 is arranged at one side of the door 34 to lock the latter and deny a customer access to the interior of the receptacle during other segments of the operational cycle. An indicator switch 40 is mounted in the receptacle adjacent to the door, and provides an output signal which indicates whether the door is presently open or closed.

Figure 4:
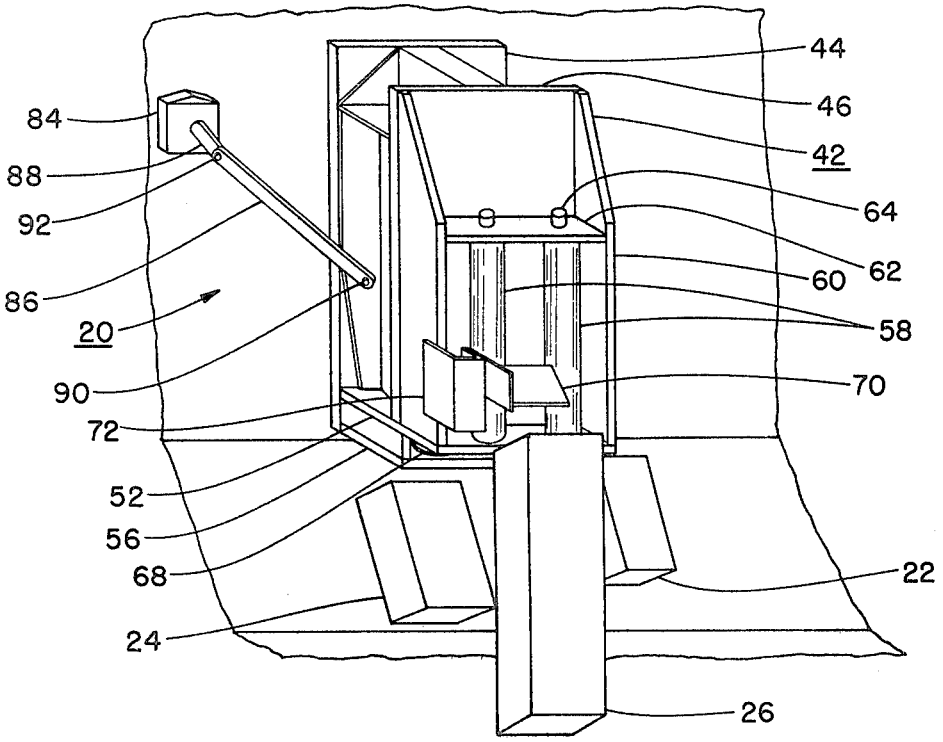
FIG. 4 illustrates, in a perspective view, various of the major internal components of the apparatus which are mounted on the interior of the top front panel.
Figure 2:
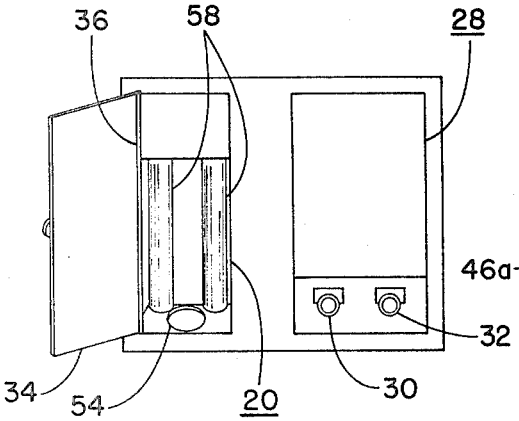
FIG. 2 is a view of a portion of the front panel shown in FIG. 1, illustrating the container depository chamber with its door opened, and the display portion of the front panel.
Figure 6:
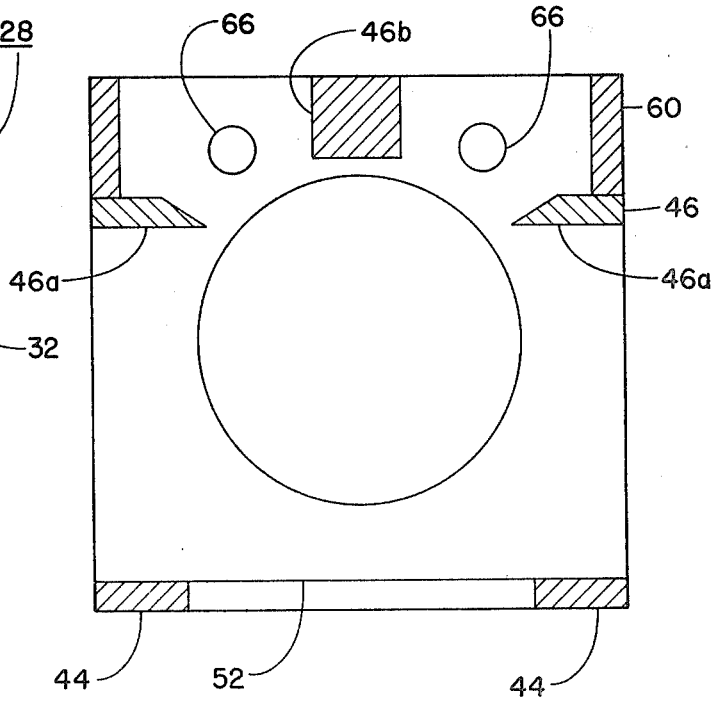
FIG. 6 is a sectional view taken along line 6—6 in FIG. 5.
Figure 5:
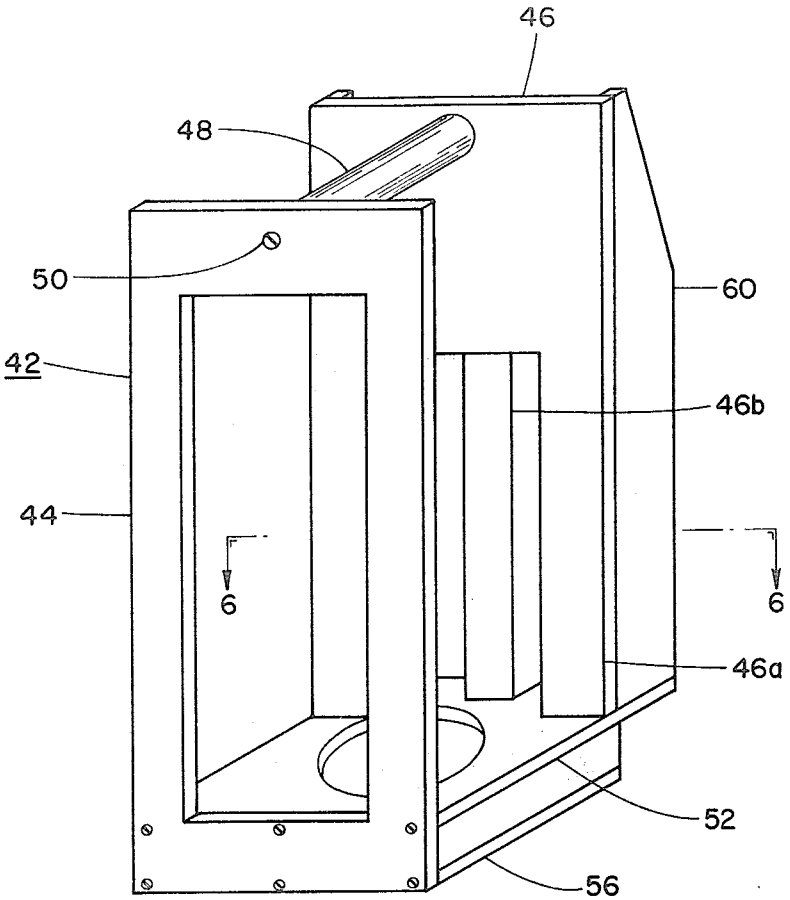
FIG. 5 is a front elevational perspective view of the housing for the container depository chamber.

The main frame 42 of the container depository receptacle or compartment 20 is illustrated in detail in FIGS. 4 and 5, and includes a front frame member 44 which is shaped like a hollow rectangle, and a rear frame member 46 having the general configuration of an inverted U-member. The front and rear frame members 44, 46 are connected at the top by means of a bar 48 of circular cross section to which they are attached by metal fastening screws or bolts 50. The floor of the depository receptacle 20 includes a rectangularly-shaped frame member 52 with a circular cutout having a turntable 54 rotatably mounted therein, and with member 52 being attached to the front and back frame members 44, 46 by suitable fastening screws. A generally rectangular base member 56 is positioned below the floor, and is also fastened to the front and back frame members 44, 46 through the use of suitable screws. All of the frame members 44, 46, 52, 56 of the depository receptacle 20 may be formed from aluminum stock or some other appropriate material. The floor 52 of the receptacle is basically horizontal, but is inclined slightly rearwardly with respect to the horizontal, as illustrated in FIG. 3, whereby a container inserted in the receptacle 20 is inclined towards the rear frame member 46, the latter of which includes two end walls **46*a* and a set-back center post or wall 46*b***.

Two substantially vertically oriented, but slightly rearwardly tilted rollers 58 are positioned one each in the spaces intermediate each end wall **46*a* and the center wall 46*b* so as to extend orthogonally relative to the floor of frame member 52. These two rollers 58 are mounted close to the periphery of the turntable 54, and all three of these components are adapted to rotate in unison so as to, in turn, cooperatively rotate a container placed in the compartment 20. Two upright auxiliary frame members 60 extend rearwardly from the back of each side of the main rear frame member 46 and at their upper ends support between them a generally horizontal frame member 62. The rollers 58 are journaled for rotational movement at their upper ends in the auxiliary frame member 62 and at their lower ends in the frame member 52. The rollers 58 may be formed from any suitable plastic material, and are constructed with small diameter stub ends 64 at each end thereof which extend into apertures 66 formed in the upper and lower supporting frame members. The stub ends 64 at the bottom end of each roller have gear teeth formed around their circumference to enable the rollers to be rotated. Conventional gearing 68 is positioned in the space between the frame member 52 and the base member 56, and synchronizes the rotational movements of the two rollers 58 and the turntable 54 whereby the turntable 54 rotates in a first direction and the two rollers 58 rotate in an opposite direction, all three rotatable parts 54, 58 being adapted to cooperatingly rotate a container inserted within the depository 20. Rotation of a container in this manner causes identifying indicia or code markings on the container to be moved past the laser beam scanner 26 which is designed to scan and read these markings. The laser beam scanner 26** may be commercially available, such as from Accu-Sort Systems, Inc., Telford, Pa. 18969.

The scanner 26 is mounted behind and below the depository housing 42, and its beam is directed from the scanner to an angled mirror 70 supported by brackets 72 at the rear of and between the two rollers 58. The angled mirror 70 reflects the laser beam from between the two rollers onto the code markings on the container, and the reflected radiation passes back by means of the mirror into the scanner where it is detected. The code output of the scanner 26 is then compared with the known codes of various selected groups of products which may be accepted for recycling by the machine. If the code on the container matches one of the selected code groups, the container is accepted by the apparatus 10. If a match is not indicated, the container is then rejected and an appropriate notification is displayed on the front panel indicating to the customer that the container is not acceptable by the machine and should be returned to personnel of a retail establishment or otherwise disposed of by the customer.

Figure 7:
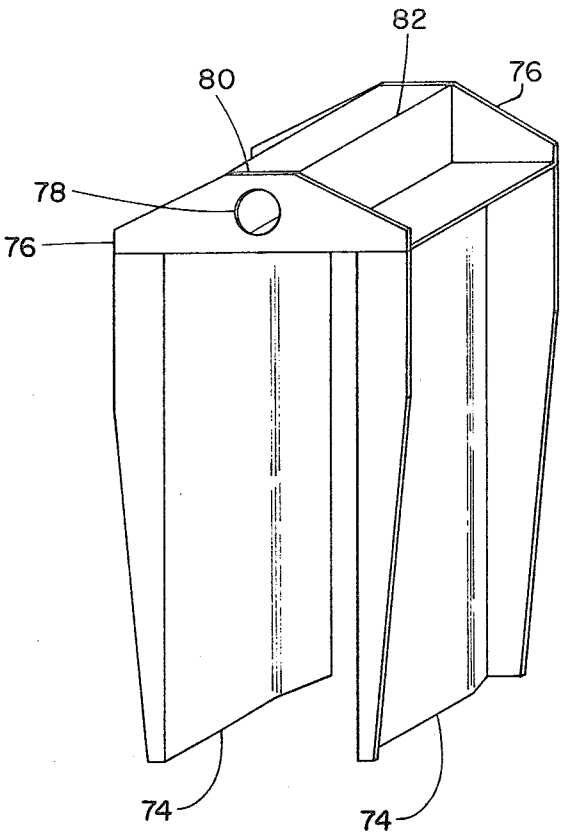
FIG. 7 is a perspective view of the assembly forming the top and side walls of the container depository chamber.

The side and top walls or members 74, 76 of the depository 20 are formed by an inverted U-shaped element, as illustrated in FIG. 7. The top of the inverted U-shaped member includes a through aperture 78 by means of which the element is suspended for pivotal movement about the bar 48 of the depository housing. The side members 74 may be formed of sheet metal with the sides bent in a wide U-shape when viewed from the bottom thereof, but with the rearward sections of the sides of the "U" being bent slightly inwardly such that the chamber defined thereby narrows slightly at its rearward portion. The top member 76 may be formed of a first outer sheet metal section having a broad U-shape when viewed from the side, and having the central portions 80 thereof slightly elevated. A square bar 82, having aperture 78 extending therethrough, extends front to back between the front and rear raised central portions 80 of the top member 76. Square bar 82 provides a solid support about which the inverted U-shaped element rotates, and may be formed of aluminum, plastic, steel, or some other suitable material.

After a container is placed in the depository chamber and its code is scanned and accepted, the inverted U-shaped element is caused to rotate about the bar 48 by an electric motor 84. The electric motor 84 is mounted on the interior wall surface of the front panel 14, and is coupled to the inverted U-element by first and second linkage arms 86 and 88. The first linkage arm 86 is pivotally attached at one end 90 thereof to one side of the inverted U-element, and is pivotally attached at the second end 92 thereof to the second linkage arm 88. The second linkage arm 88 is fixedly mounted at its other end 94 to the shaft of the motor. The motor 84 is of the type which, upon being energized, rotates one complete revolution and then stops. A motor of this type may be provided with a cam-actuated switch (not shown) positioned adjacent to the motor shaft so as to sense its rotational movement, and which is adapted to cut off power input to the motor after one complete revolution thereof. These motors are commercially available and accordingly, the details of their construction need not be further explained herein. The complete single revolution of the shaft of the motor causes the linkage arms 86, 88 to pivot the lower portion of the inverted U-element towards the left as seen in FIG. 4 and, in consequence thereof, causes the container in the depository 20 to drop out of the bottom of the element at that side. The falling container contacts the portion 96 of the front panel 14 which slants downwardly and into the interior of the apparatus 10 so as to be deflected thereby to the compactor unit 12 of the machine. The motor 84 and linkage arms 86, 88 also function to lock the inverted U-element into place when the interior of the container depository 20 is accessible to the customer, in effect, when the door 34 is unlocked. This locking function is accomplished by the action of the cam cutoff switch for the motor 84 causing the latter to stop while the two linkage arms 86, 88 are in a colinear relationship, as illustrated in FIG. 4, which effectively prevents the inverted U-element from being pivoted by a customer, either on purpose or inadvertently.

Accepted containers are accumulated within a receptacle 98 in the compactor unit 12. In the disclosed embodiment, the compactor is activated after each tenth container accepted by the machine so as to periodically compact or crush the accumulated containers. This may be functionally accomplished by a divide-by-ten circuit which produces an output for each ten input signals indicating an accepted container, and initiates the activation of the compactor unit 12. During operation of the compactor, the front door 34 to the container depository 20 is latched shut. The use of a compactor unit 12 enables a large number of returned containers to be accumulated within the machine 10 before the compactor receptacle 98 needs to be emptied. This arrangement results in a very efficient utilization of the floor space of the establishment in which the recycling machine 10 is located. A suitable compactor unit for use in the disclosed embodiment is available from Consolidated Bailing Machine Company, Brooklyn, NY. 11215.

The change dispenser 22 may be of any one of several commercially available designs and, accordingly, is not described in detail herein. A suitable coin dispenser may be purchased from National Rejectors Industries, P.O. Box 1550, Hot Springs, Ark. 71901.

The chit or token dispenser 24 may issue any one of several different types of chits such as coupons, tokens, tickets, or the like. A suitable chit dispenser, issuing a ticket which may be suitably marked for redemption at a retail store and credited toward the purchase of select goods, is commercially available from Consolidated Engineering and Manufacturing Corporation, 1515 Melrose Lane, P.O. Box 105, Forest Hills, Md. 21050. In a preferred embodiment of the present invention, the dispensed chit is redeemable for a face value greater than the monetary amount receivable from the coin dispenser. The chit is redeemable against the purchase of a particular manufacturer's goods, and the greater value of the chit encourages the purchase by the customer returning the container of that particular brand of products.

The determination of whether the returned container is one of several acceptable types is made in accordance with the scanned indicia or code markings placed on the container. An appropriate code marking which may be utilized in the practice of the present invention is the Universal Product Code (UPC) symbol system. The UPC bar code system provides for the binary coding of ten decimal digits. In practice, the first five of these digits identify the producer of the item, and the last five identify the particular item within the product line. Each of the ten digits used to identify the item is represented by a specific group of bars, and the encoding of the digits is obtained by variations in the width of bars making up the coded group. In other embodiments of the present invention other codes may be utilized, or alternatively a recognizable emblem or surface contour on the container may be detected in some suitable manner. In the illustrated embodiment, the UPC code is detected by the code scanner 26, and its output is compared, by one or more comparator circuits, to ascertain if the detected code represents one of the several groups of selected types of products. For instance, in the disclosed embodiment, there are facilities for accepting selected types of containers from six separate manufacturers, and six individual counters 100 are provided on an exterior side wall of the machine whereby the number of returned and acceptable containers from each of the six manufacturers is recorded by the counters. The counters enable each manufacturer to be billed a correct amount in conformance with the number of returned containers in the machine.

Figure 8:
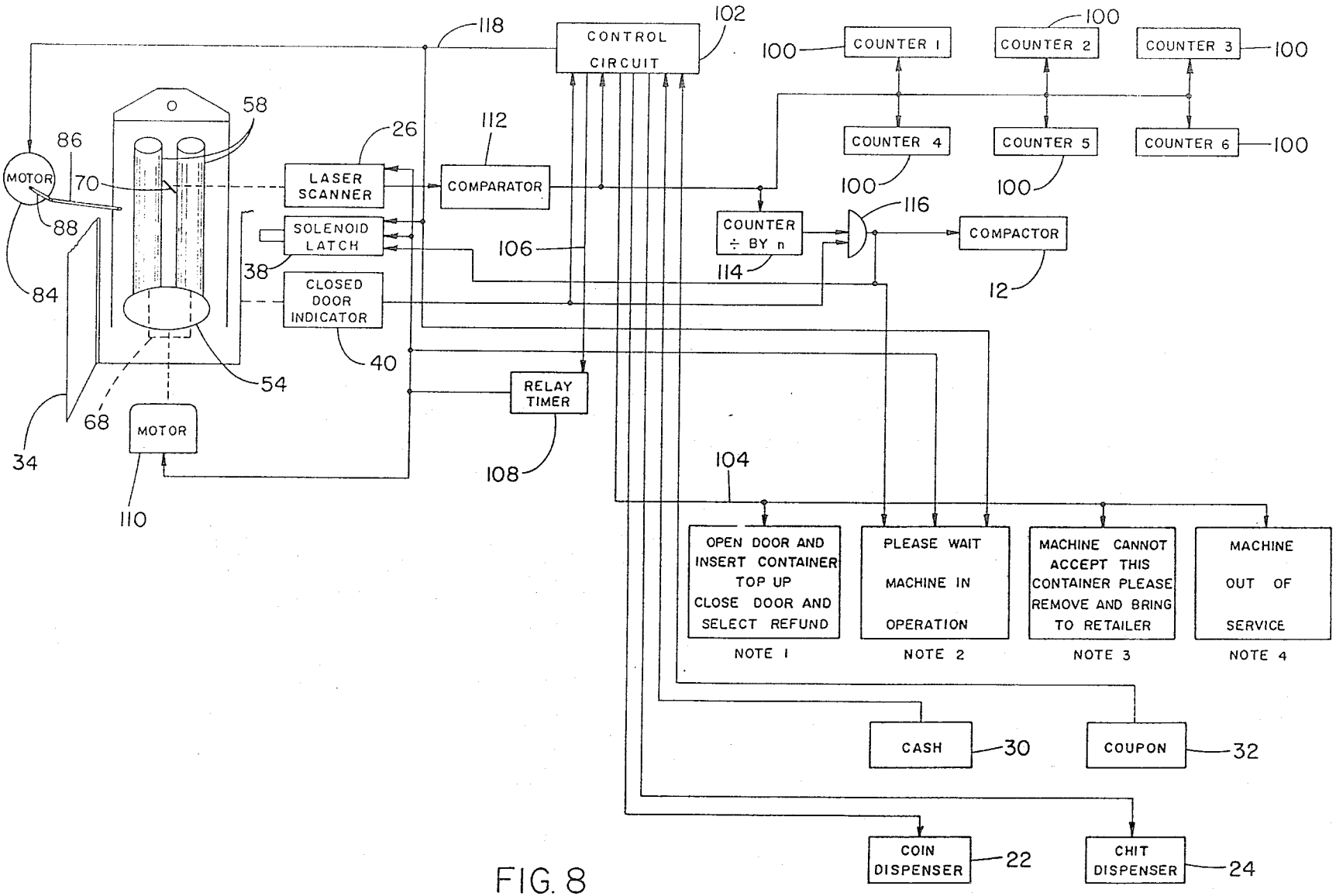
FIG. 8 is a block diagram schematically illustrating the major electronic elements utilized in controlling the sequence of operation of the recycling apparatus.

A schematic block diagram showing the major electronic elements and their functional interrelationship is illustrated in FIG. 8. The rollers 58, turntable 54 and their mechanical interconnection 68 are illustrated schematically, as is the door 34 with its solenoid latch 38 and switch 40 indicating the position of the door. The motor 84 for causing an accepted container to be ejected from the container depository is shown in its stationary position with the linkages 86 and 88 being in a colinear position. The machine also includes four different messages, shown as Notes 1 through 4 in FIG. 8, which are activated at appropriate times by a control circuit 102.

One operational cycle of the recycling machine 10 will now be explained with reference to the control circuit of FIG. 8:

Prior to use of the recycling machine by a customer, the control circuit 102 directs a signal on line 104 (the loops around line 104 indicate that the line is in fact a bundle of several lines) to activate "Note 1", which instructs the customer to insert a container, top up, into the machine, close the door 34, and make a refund selection, i.e. either monetary or chit. Following the instructions, a customer inserts a container into the depository 20, and pushes either the selection button 30 for a refund of cash or the selection button 32 for the issuance of a coupon. Assuming the coupon button 32 is pushed, a signal transmitted from button 32, along with a signal from the closed door indicator switch 40, causes the control circuit 102 to issue a signal on line 106 to a relay timer 108. In response thereto, the relay timer circuit produces an output signal for a given duration of time so as to simultaneously activate the solenoid latch 38 thereby locking the container receptacle door; activate a motor 110 which will rotate the turntable 54 and rollers 58; activate the laser scanner 26 to cause the code on the container to be detected and scanned; and issue an energizing signal to "Note 2" which is illuminated to indicate to the customer that the machine is now in operation. The signal from the scanner 26 is directed to a comparator circuit 112 which compares the detected code with acceptable code groups to determine if the detected code is one from an acceptable container. If the scanned code on the container is not within an acceptable code group or, alternatively, if no code is detected, the output of scanner 26 submits that information to control circuit 102 which initiates a signal on line 104 to cause "Note 3" to be illuminated, indicating to the customer that the container is of a type which cannot be accepted by the machine. In the event the code is an acceptable type, a count signal is directed to a divide-by-n counter 114 which is then indexed one count, and the function of which is to cause compactor unit 12 to periodically cycle and crush the containers deposited therein. An appropriate output from either the counter 114 or the compactor 12 is utilized during the compacting operation to activate the solenoid latch 38 thereby locking the depository chamber.

The output signal is also utilized to illuminate "Note 2" to indicate to customers that the machine is currently in operation and to please wait a few moments more. An AND gate 116 receives inputs from both the divide-by-n counter 114 and the closed door indicator switch 40 to ensure that the door is latched prior to activation of the compactor. The output of the comparator circuit 112 is also directed to an appropriate one of the individual counters 100 in order to add a count to the total present in that counter each time a container of that particular group type is accepted by the machine. The output of the comparator 112, indicating that the detected code is one from an acceptable container, is also directed to control circuit 102 which issues a command on line 118 which is directed to: the solenoid latch 38 to lock the depository door 34; motor 84 to activate the shaft of that motor for one revolution; and "Note 2" to indicate to the customer that the machine is in operation. The revolution of motor 84 causes the inverted U-element to pivot towards the left, as shown in FIG. 8, and push the container off the turntable 54 and frame member 52. The container then falls from the bottom of the inverted U-element down into contact with the inclined inner surface 96 on the front panel 14, from which it is then deflected into the receptacle 98 in the compactor unit 12. The motor 84 continues through its one revolution so as to reposition the inverted U-element at its normal inoperative position. The control circuit 102 also issues concurrently therewith a command to either the coin dispenser 22 or the chit dispenser 24, in conformance with the signal received from either the cash button 30 or the coupon button 32, to thereby issue the proper refund to the customer.

While a preferred embodiment of the invention has been described in detail, it should be realized by one skilled in the art that the contribution of the present invention to the state of the art may encompass many variations. For instance, in some embodiments of the invention it may be desirable to substitute a grinder or shredder for the compactor, or alternatively to merely accumulate the accepted containers in a large bin or direct the containers to a grinder or shredder. This will substantially increase the compaction and the container will lose its identity. Moreover, the number and types of groups of acceptable containers may vary from embodiment to embodiment. Furthermore, the arrangement of the turntable and rollers within the container depository may vary in different embodiments. Also, the laser scanner may be replaced by other appropriate types of scanning or detecting equipment. The UPC symbol may also be replaced by a more readily recognizable emblem or surface contour which can be "read" by various techniques.

What is claimed is:

1. Recycling apparatus for accepting the return of selected types of containers and for compensating a returnor for the deposit therein of one of the selected types, comprising:

a. a depository means for receiving containers from a returnor, a lockable container infeed door for said depository means, means for rotating a container within said depository means to enable scanning of code markings on said container, including a substantially horizontal turntable in said depository means slightly inclined from the horizontal, and at least one substantially vertically extending roller positioned in the depository means proximate the periphery of the turntable and adapted to have a container tilted thereagainst, said turntable and roller being rotated in unison so as to impart rotation to a container inserted in the depository means and supported on said turntable;

b. scanning means for scanning code markings on a container, placed in the depository means, determinative of said selected container type;

c. control means responsive to the output of said scanning means for selectively accepting or rejecting a container predicated on the output of said scanning means, said control means including means for causing said lockable door to be latched during said scanning cycle, and means for causing said turntable to rotate a number of revolutions to facilitate said scanner means to at least once scan the code markings on the container;

d. dispensing means responsive to the output of said control means for dispensing selective types of compensation to the returnor upon acceptance of a returned container; and e. a receptacle in said apparatus for receiving and accumulating accepted containers.

2. Recycling apparatus for accepting the return of selected types of containers and for compensating a returnor for the deposit therein of one of the selected types, comprising:

a. a depository means for receiving containers from a returnor, a lockable container infeed door for said depository means, means for rotating a container within said depository means to enable scanning of code markings on a container, said depository means including an inverted U-shaped element having the two legs of the "U" forming two sides of said depository means, and means for pivoting said inverted U-element about an axis at the apex of said U-shaped element located above said depository means;

b. scanning means for scanning code markings on a container, placed in the depository means, determinative of said selected container type;

c. control means responsive to the output of said scanning means for selectively accepting or rejecting said container predicated on the output of said scanning means, said control means including means for causing said lockable door to be latched during said scanning cycle, and means for activating said pivoting means upon acceptance of a container by the apparatus;

d. dispensing means responsive to the output of said control means for dispensing selective types of compensation to the returnor upon acceptance of a returned container; and e. a receptacle in said apparatus for receiving and accumulating accepted containers.

3. Recycling apparatus as claimed in claims 1 or 2, said dispensing means comprising monetary dispensing means for issuing a given amount of money; chit dispensing means for dispensing a chit redeemable for the purchase of particular products in lieu of said amount of money, said chit having a value in excess of said given amount of money; and selector means for enabling the returnor to select the receipt of either said given amount of money or one of said chits, said control means being responsive to the output of said selector means to activate either said monetary dispensing means or said chit dispensing means.

4. Recycling apparatus as claimed in claims 1 or 2, comprising a plurality of counters, one counter being provided for each of said selected types of containers for respectively counting the number of accepted containers of each type.

5. Recycling apparatus as claimed in claims 1 or 2, comprising compactor means for periodically compacting returned containers, said receptacle being arranged in said compactor means, said control means including means for activating said compactor periodically after a given number of containers has been deposited and accepted for compacting.

* * * * *